US007466231B1

(12) United States Patent
Seevers

(10) Patent No.: US 7,466,231 B1
(45) Date of Patent: Dec. 16, 2008

(54) SELF-CHECKOUT SYSTEM

(75) Inventor: Daniel B. Seevers, Lawrenceville, GA (US)

(73) Assignee: NCR Corporation, Dayton, OH (US)

( * ) Notice: Subject to any disclaimer, the term of this patent is extended or adjusted under 35 U.S.C. 154(b) by 239 days.

(21) Appl. No.: 11/253,864

(22) Filed: Oct. 19, 2005

(51) Int. Cl.
*G08B 13/14* (2006.01)

(52) U.S. Cl. ..... 340/568.1; 340/572.1; 340/572.9; 340/825.49; 340/10.1; 235/385; 186/35; 186/52; 186/59

(58) Field of Classification Search ..... 340/568.1, 340/572.1, 572.3, 10.1, 10.4, 10.41, 572.8, 340/572.9, 568.8, 825.36, 825.49; 186/35, 186/52, 59; 235/385
See application file for complete search history.

(56) References Cited

U.S. PATENT DOCUMENTS 3,707,826 A * 1/1973 Cole ..... 53/384.1
5,115,888 A * 5/1992 Schneider ..... 186/61
5,123,494 A * 6/1992 Schneider ..... 177/50
5,426,282 A * 6/1995 Humble ..... 235/383
6,347,137 B1 * 2/2002 Mason ..... 379/167.03
6,710,797 B1 * 3/2004 McNelley et al. ..... 348/14.16
6,982,388 B2 * 1/2006 Kasinoff ..... 177/2
6,994,252 B2 * 2/2006 Frich ..... 235/381
7,034,679 B2 * 4/2006 Flynn ..... 340/540
2005/0207589 A1 * 9/2005 Biegelsen ..... 381/77
2006/0280315 A1 * 12/2006 Norris et al. ..... 381/77

* cited by examiner

*Primary Examiner*—Daniel Previl
(74) *Attorney, Agent, or Firm*—Paul W. Martin

(57) ABSTRACT

A self-checkout system 1 includes a console 2 for interacting with a user, in the form of consumer 3. This consumer 3 is located within a spatially defined control zone 4 during such interaction. An interface 5 is responsive to console 2 for receiving a first signal 6 indicative of an audible representation 7. A processor 8 is responsive to the signal 6 for selectively defining a second signal, in the form of ultrasonic transmission 9. An output, in the form of an ultrasonic transducer 10, is responsive to processor 8 for propagating transmission 9 to provide only in the control zone 4 audible representation 7. Representation 7 is substantially inaudible outside of zone 4.

5 Claims, 5 Drawing Sheets

SELF-CHECKOUT SYSTEM

FIELD OF THE INVENTION

The present invention relates to a self-checkout system.

The invention has been primarily developed to reduce customer confusion and noise levels in areas including a number of self-checkout systems. However, the invention is by no means restricted to that field of use, and has various alternate applications.

BACKGROUND

Any discussion of the prior art throughout the specification should in no way be considered as an admission that such prior art is widely known or forms part of common general knowledge in the field.

It is common for retail venues to implement self-checkout systems. Typically, a consumer collects one or more consumer items from within the retail venue, and subsequently interacts with a self-checkout system to settle an account for payment of the items. The system includes an identification device for obtaining identification information from the item or items, such as a barcode scanner or RFID reader. The system also includes a console with which the consumer interfaces. This console provides information to the consumer to assist in the usage of the system. For example: instructions for the consumer to follow. In most cases, self-checkout systems provide this information as an audible representation—usually digitally reproduced speech. This both provides a quasi-human element to the system, and reduces the need for the consumer to read a display screen.

Self-checkout systems are often proximally located within a common self-checkout zone. As such, consumers are susceptible to confusion as a result of hearing information provided by a system other than the one they are using. It will be appreciated that the inevitable jumble of conflicting noises in self-checkout zones cause confusion and arguably detracts from a consumer's retail shopping experience.

SUMMARY

It is an object of the present invention to overcome or ameliorate at least one of the disadvantages of the prior art, or to provide a useful alternative.

In accordance with a first aspect of the invention, there is provided a self-checkout system including:

- a console for interacting with a user when the user is located within a spatially defined control zone;
- an interface responsive to the console for receiving a first signal indicative of an audible representation;
- a processor responsive to the first signal for selectively defining a second signal; and
- an output responsive to the processor for propagating the second signal to provide only in the control zone the audible representation.

Preferably the output is an ultrasonic transducer. More preferably the second signal is an inaudible ultrasonic transmission, and the transducer outputs this ultrasonic transmission such that inherent properties of air within the control zone distort the ultrasonic transmission to provide the audible representation. Even more preferably, the audible representation is substantially inaudible outside of the control zone. In some embodiments the transducer is mounted to the console, whilst in other embodiments the transducer is spaced apart from the console.

In a preferred embodiment the console and a second console having a second control zone are located within a common checkout zone, and the audible representation is not audible to a user of the second console.

Preferably the console is responsive to an action of the user for defining the first signal. More preferably the first signal is indicative of an instruction to assist the user in interacting with the console.

In some embodiments the console receives the first signal from a central communications unit. Preferably the central communications unit includes an input for receiving from an operator an operator statement, and the audible representation is substantially a reproduction of the operator instruction. More preferably the operator statement is verbal. Also preferably, the central communications unit is configured for selective communication with a plurality of consoles. Preferably the system includes a communications device for receiving a verbal signal from the user and transmitting the verbal signal to the central communications unit. More preferably the operator interacts with the central communications unit from within an operator zone, and the central communications unit includes:

- an interface for receiving data indicative of the verbal signal;
- a processor responsive to the data for selectively defining a third signal; and
- an output responsive to the processor for propagating the third signal to provide in the operator zone a substantial reproduction of the verbal signal.

Preferably the central communications unit includes a monitor for providing data indicative of the status of the console.

According to a second aspect of the invention, there is provided a method for providing feedback to a user of a self-checkout system when the user is located within a spatially defined control zone, the method including the steps of:

- receiving a first signal indicative of an audible representation;
- being responsive to the first signal for selectively defining a second signal; and
- propagating the second signal to provide only in the control zone the audible representation.

According to a further aspect of the invention, there is provided a feedback device for a self-checkout system, the device including:

- an interface for receiving from the self-checkout system a first signal indicative of an audible representation;
- a processor responsive to the first signal for selectively defining a second signal; and
- an output responsive to the processor for propagating the second signal to provide only in the control zone the audible representation.

BRIEF DESCRIPTION OF THE DRAWINGS

Benefits and advantages of the present invention will become apparent to those skilled in the art to which this invention relates from the subsequent description of exemplary embodiments and the appended claims, taken in conjunction with the accompanying drawings, in which:

DETAILED DESCRIPTION

Figure 1:
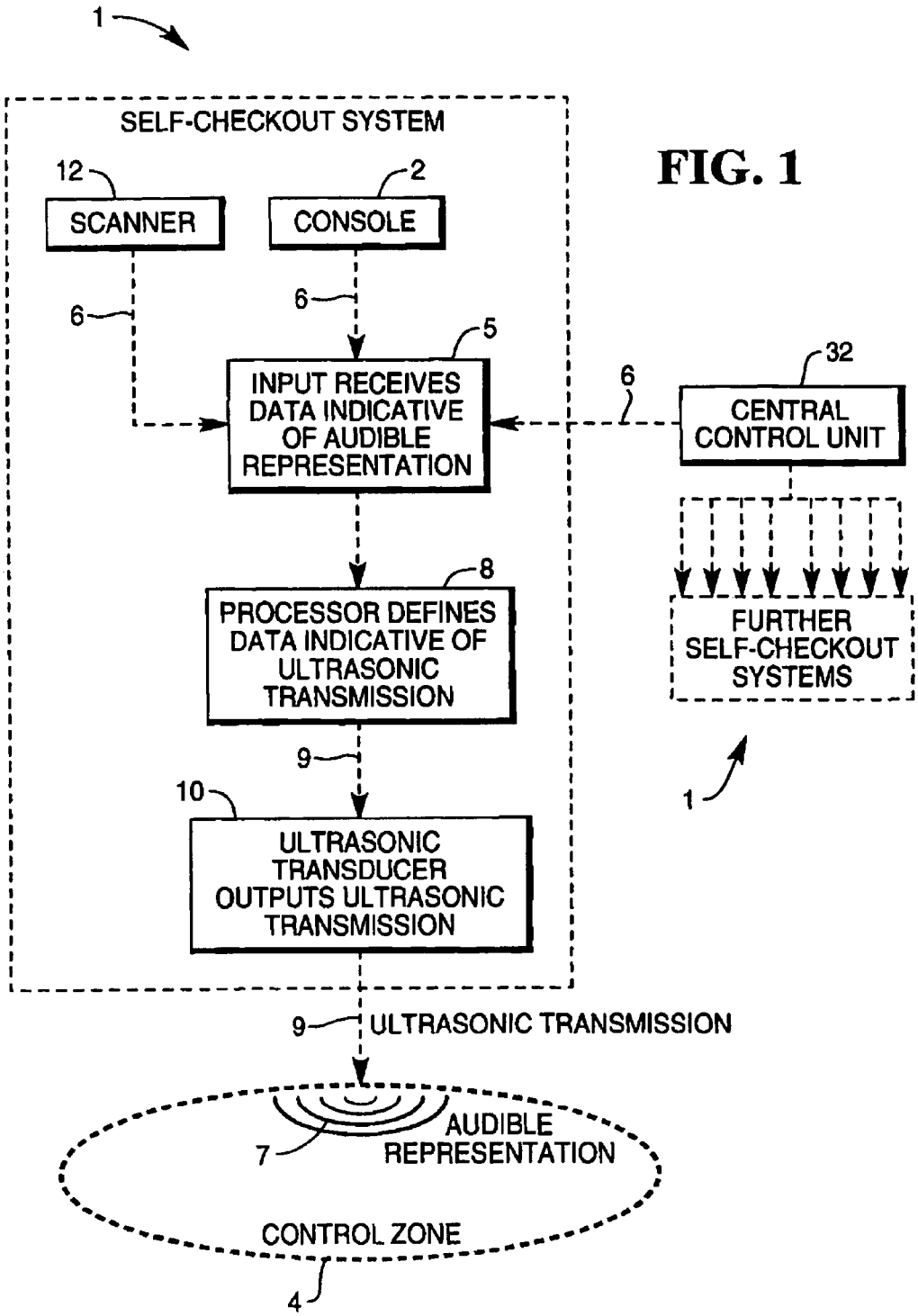
FIG. 1 is schematic representation of a self-checkout system according to the present invention.
Figure 2:
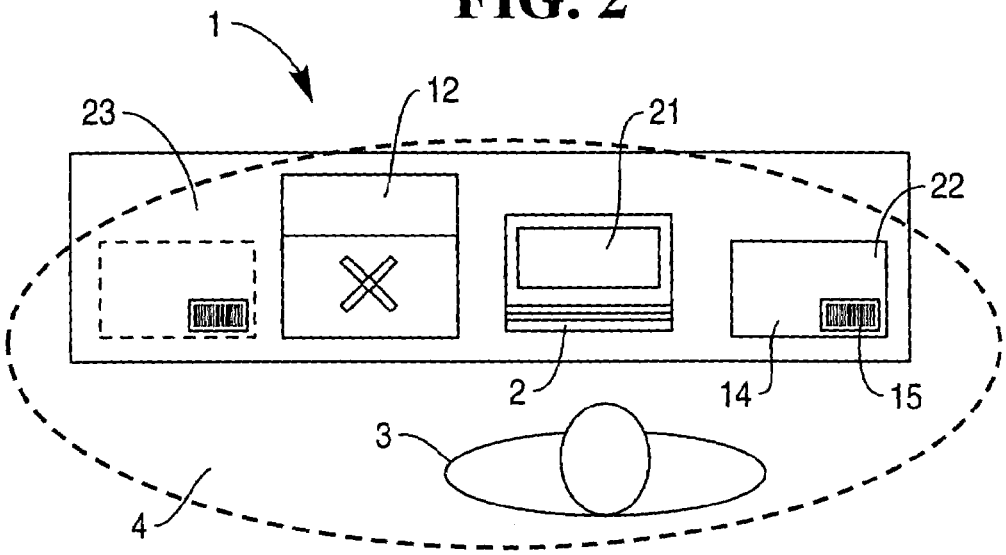
FIG. 2 is a schematic plan view of an the self-checkout system of FIG. 1.
Figure 3:
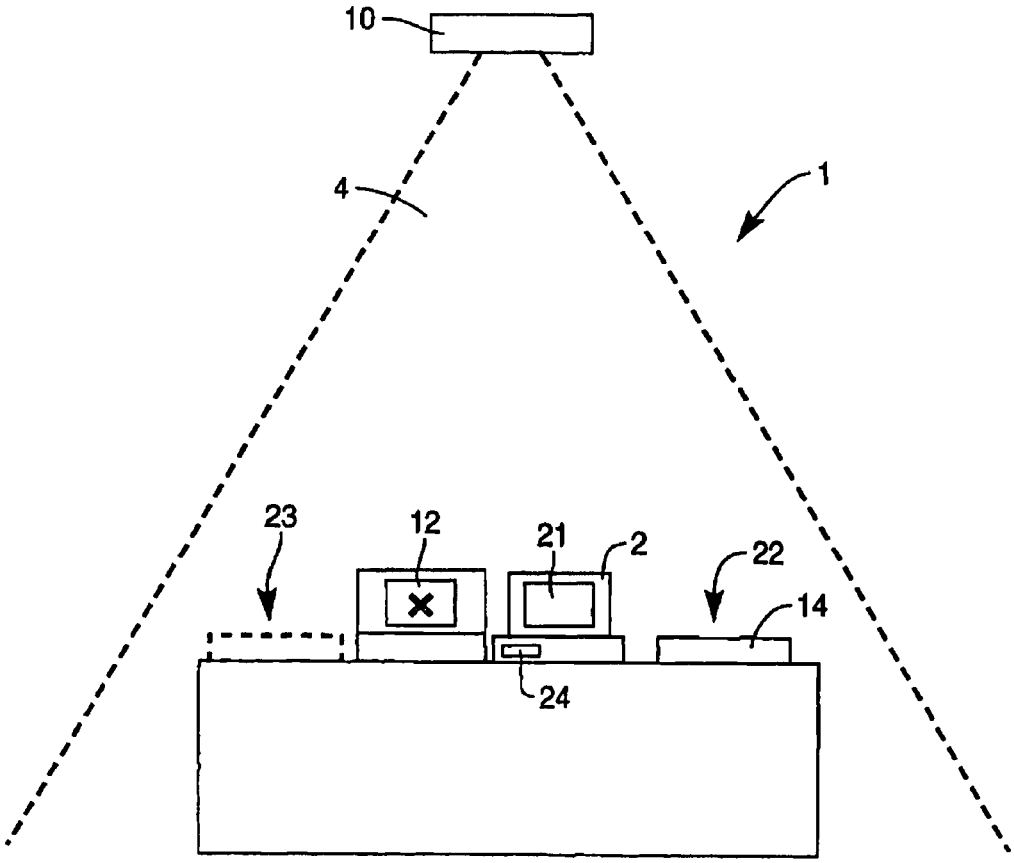
FIG. 3 is a schematic side view of the self-checkout system of FIG. 2.

Referring to the drawings, it will be appreciated that, in the different figures, corresponding features have been denoted by corresponding reference numerals.

A self-checkout system 1 includes a console 2 for interacting with a user, in the form of consumer 3. This consumer 3 is located within a spatially defined control zone 4 during such interaction. An interface 5 is responsive to console 2 for receiving a first signal 6 indicative of an audible representation 7. A processor 8 is responsive to signal 6 for selectively defining a second signal, in the form of ultrasonic transmission 9. An output, in the form of an ultrasonic transducer 10, is responsive to processor 8 for propagating transmission 9 to provide only in the control zone 4 an audible representation 7. Representation 7 is substantially inaudible outside of zone 4.

In the present embodiment transducer 10 outputs transmission 9 such that inherent properties of air within zone 4 distort transmission 9 to provide representation 7. This will be recognized as a utilization of hypersonic sound. In other embodiments, alternate hypersonic transmission techniques are used to substantially limit the audibility of representation 7 to the space defined within zone 4. Those skilled in the art will recognize such techniques, and understand how they are used in alternate embodiments of the invention. The underlying rationale is that a directed and substantially focused beam of sound is created to define zone 4 such that representation 7 is audible only in zone 4. The theory, mathematics and engineering of such sound transmission systems falls beyond the scope of this disclosure, and it will be appreciated that known hardware is typically used for the purposes of transducer 10, and known hardware and/or software is used to achieve certain functionalities of processor 5.

It will be appreciated that the positioning and configuration of transducer 10 defines zone 4. The general notion is that consumer 3 occupies zone 4 when interacting with console 2. This is contrasted with consumer 3 being suitably disposed to interact with console 2 from any location within zone 4. Zone 4 includes:

- Functional regions. These are regions where an average consumer's head is locatable during conventional use of system 1. For example: regions horizontally within 3 feet of console 2 and between two and nine feet above ground level.
- Non-functional regions. These are regions where an average consumer's head is not locatable during conventional use of system 1. For example: regions of zone 4 that are more than nine feet above ground level.

In cases where multiple systems 1 are proximally located, it is typically preferable to ensure that a functional region of one zone 4 does not overlap with any region of another zone 4. That is, a consumer does not hear a representation 7 from a system 1 other than the system 1 that consumer is using. Non-functional zones often overlap, and it will be appreciated that this does not cause substantive difficulties.

In the illustrated embodiments, system 1 is implemented in a retail supermarket. Consumer 3 interacts with console 2 from within a control zone 4 defined in three-dimensional space. This control station is notionally defined by positioning of transducer 10 such that consumer 3 is able to hear representation 7 whilst using console 2. In some cases an adjustment mechanism is provided to fine tune the definition of zone 4 for consumers having particular height characteristics.

In the present embodiment, transducer 10 is spaced apart from console 2. In particular, transducer 10 is ceiling mounted substantially vertically above zone 4. In other embodiments transducer 10 is mounted to the console and directed to define an appropriate zone 4. For example, in some cases zone 4 is defined as the region the head of consumer 3 occupies during conventional use, and transducer 7 aims diagonally upward from console 2 to define a region likely to be occupied by the head of a user 2. The rationale for an upward diagonal path is to reduce the risk of overlap with functional zones of nearby zones 4.

Figure 4:
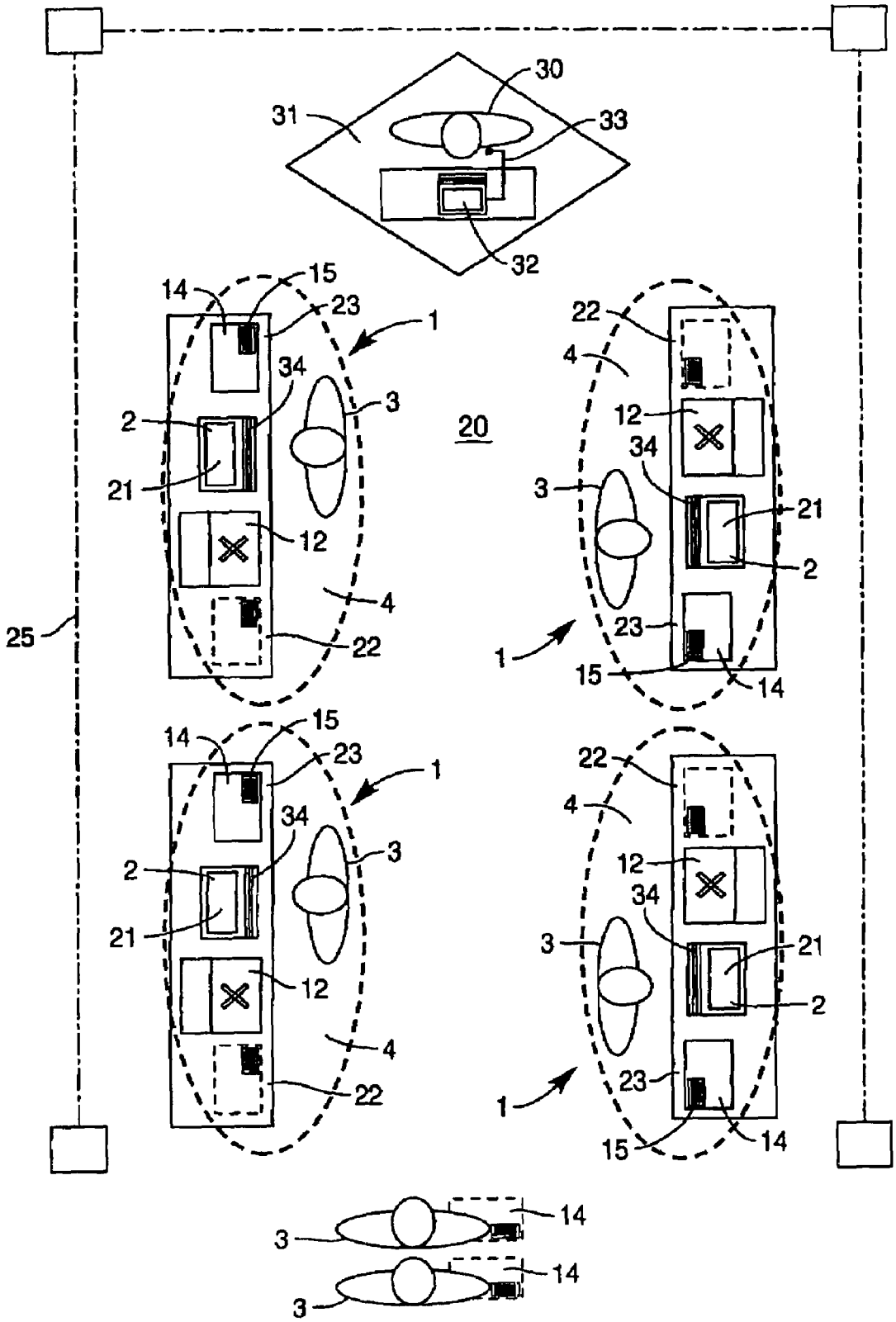
FIG. 4 is a schematic plan view of a supermarket checkout zone including several of self-checkout systems.

Typically, system 1 and a plurality of other similar systems having a respective consoles 2 and zones 4 are located within a common checkout zone 20, as shown in FIG. 4. A representation 7 is only audible in the zone 4 defined for its respective system 1.

Consumer 3 collects an item 14 having a barcode 15, the intention being to purchase that item. It will be appreciated that several items are typically collected, however a single item is considered for the sake of simplicity. Consumer 3 takes item 14 to system 1. In addition to components already discussed, system 1 includes:

- A bi-optic scanner 12 for scanning barcode 15.
- A screen 21 integrated into console 2 for providing visual information to consumer 2.
- A loading zone 22 for receiving item 14 prior to scanning.
- A packing zone 23 for receiving item 14 following scanning, this packing zone including a weighing mechanism for security purposes.
- A payment facility 24 for receiving payment from consumer 3. Payment types include cash or card-based transactions.

Any description herein relating to known features of self-checkout systems should not be regarded as limiting in any way. It is appreciated that a multitude of differing self-checkout systems are known, each making use of different hardware, software and logic. Generic examples are provided for the purposes of illustration only. Persons skilled in the art will understand how to apply the teachings herein to various known self-checkout systems. For example, some systems make use of alternate scanning equipment, security systems, payment facilities, and so on.

In some embodiments system 1 is defined solely by console 2, interface 5, processor 8 and transducer 10. In such cases other components are regarded as external to system 1.

System 1 provides instructions, niceties, feedback, and other information to consumer 3. Where reasonable, these are provided in the form of representations 7, typically as digitally reproduced speech. This provides consumer 3 with a feeling of human interaction with system 1. Not all information provided by system 1 need be in the form of a representation 7. For example, some information is provided only on, and other information on a printed receipt (not shown).

Console 2 is equipped with a logic system for providing relevant representations 7 to consumer 3. Various components of system 1 include sensors and are interlinked to provide console 2 with information to assist the selection of appropriate representations from a database of predefined representations. The logic used varies between embodiments, and examples herein are not meant to be limiting.

Upon the arrival of consumer 3 arrival, system 1 provides an instruction to consumer 3, typically being an instruction to "touch the screen to begin" or the like. Using one or more appropriate predefined representations 7 either in isolation or in conjunction with images on screen 21, console 2 prompts consumer 3 to pass item 14 through a scanning zone defined by a scanner 12 to read barcode 15. In other embodiments alternate identification techniques are used, such as RFID tagging or other types of barcodes and or scanners.

Figure 5:
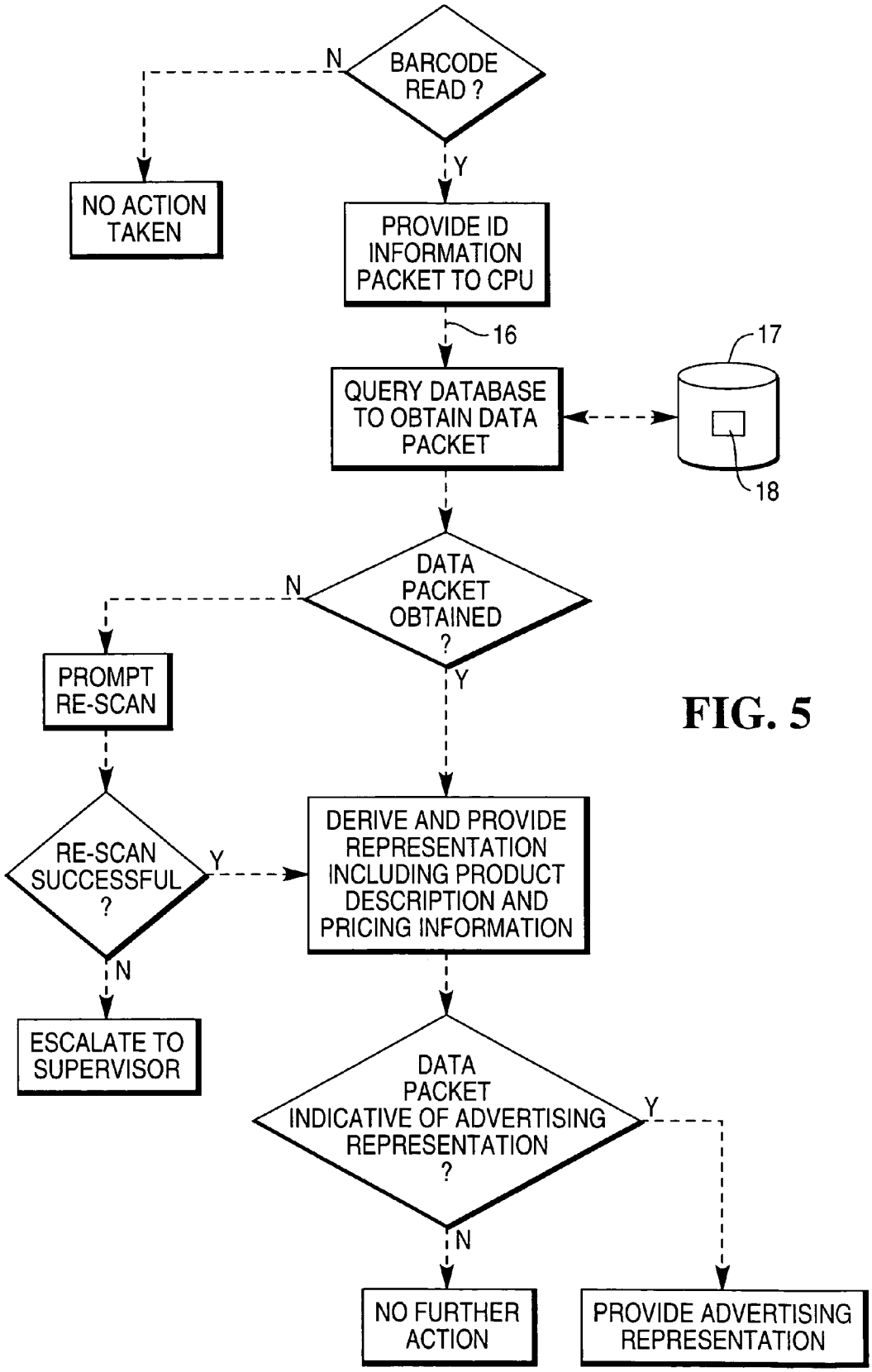
FIG. 5 is a flowchart showing an exemplary method of processing a scanned barcode.

Scanning barcode 15 obtains some information about item 14. A flowchart illustrating the scanning process is provided in FIG. 5. In brief, scanner 12 reads a barcode 15, and an identification information packet 16 is extracted. This is typically an alphanumeric string of data indicated by lines on the barcode. On the basis of packet 16, a database 17 is queried to obtain a data packet 18. Data packet 18 includes product information that in theory relates to the product carrying the scanned barcode. For example: a product weight threshold range, pricing information, a product description, and so on. Some of these are linked to representations 7, or representations 7 are alternately derived on the basis of the information. For example, packet 18 includes a description entry "product X" and a pricing entry "$Y". System 1 defines and produces a representation 7 in the form of speech along the lines of "product X, Y dollars".

In the present embodiment advertising information indicative of an advertising representation 7 is also provided in packet 18. For example, the consumer is informed "thank you purchasing product X, be sure to SMS your product ID code to location A for the chance to win prize B".

In some cases no packet 18 is obtainable for a given packet 16. In such a case, system 1 provides a representation 7 prompting consumer 3 to scan the barcode again, or alternately escalates the issue for attention by a human supervisor.

Where scanning and the obtaining of packet 18 are successfully completed, a representation 7 instructs consumer 3 to place item 14 in packing zone 23. Item 4 is then weighed to ensure that the weight of item, 14 is within the threshold range defined in packet 18. This is used as a security measure. Other security measures are also used. For example, some items carry security RFID tags that are automatically deactivated following scanning. An RFID interrogation field 25 defines a border between systems 1 and the exterior of the supermarket, and an alert is raised where an active security RFID tag passes through this border.

The next major step involves a series of representations 7 that guide consumer 3 through an interaction with payment facility 24. This interaction obtains funds or credit from consumer 3, and completes the process. This is marked by a representation along the lines of: "Your payment has been approved. Thank you for shopping with us, and have a nice day".

Referring to FIG. 4, a supervisor 30 oversees multiple systems 1 from a platform 31. This platform includes a central communications unit 32. Unit 32 allows supervisor 7 to selectively provide a representation 7 in the zones 4 of a selected one or more systems 1. For example, where the inbuilt logic of console 2 inherently fails to handle a situation, and human assistance is necessitated.

Unit 32 includes an input, in the form of microphone 33. Supervisor 30 selects one or more of systems 1 to which a message is to be sent, and speaks the message into microphone 33. Unit 32 digitizes the message into a signal, which sent to the selected system 1, and received by the relevant interface 5 as a signal 6. Processor 8 defines a transmission 9 on the basis of signal 6, and transducer 10 propagates this signal to produce a representation 7 in zone 4. This representation is substantially a reproduction of the message spoken by supervisor 30.

In some embodiments system 1 includes a microphone 34 mounted to console 2. This microphone is responsive to a verbal signal from consumer 3 for transmitting the verbal signal to the unit 32 where it is heard by supervisor 30. This facilitates two-way communication between the consumer and the supervisor. Typically, microphone 34 is only activated in response to a command provided by supervisor 30. For example, consumer 3 presses a "help" button, and supervisor 30 activates microphone 34 for a limited time period during which he or she desires to converse with consumer 3. It will be appreciated that such an approach is implemented such that operator 30 is not presented with a jumble of discussion and ambient noise from regions adjacent the multiple systems 1.

In some embodiments unit 32 also makes use of hypersonic sound. That is, supervisor 30 operates unit 32 from within an operator zone, and unit 32 includes an interface for receiving data indicative of a verbal signal from a microphone 34. A processor is responsive to the data for selectively defining an ultrasonic transmission. An ultrasonic transducer provides only in the operator zone a substantial reproduction of the verbal signal.

In the present embodiment, scanner 12 also provides a signal 6 to interface 5. This signal is typically indicative of a barcode 15 being read, and the associated representation 7 is a "beep". A similar functionality is common in scanners, however in this case the functionality is linked with hypersonic sound such that the "beep" is not heard by other consumers to whom it is not relevant.

It will be appreciated that the above teachings are optimally implemented to provide a comparatively quiet supermarket self-checkout zone. This is advantageous to consumers and consumers alike. The overall effect is that consumer 3 is not troubled, confused, or indeed bombarded, with information that is not directly relevant for their purposes.

Although the present invention has been described with particular reference to certain preferred embodiments thereof, variations and modifications of the present invention can be effected within the spirit and scope of the following claims.

What is claimed is:

1. A self-checkout system including:

a console for interacting with a user when the user is located within a spatially defined control zone, wherein the console records a request from the user for assistance in interacting with the console;

an interface responsive to the console for receiving a first signal from a central communications unit indicative of an audible representation from a supervisor console in response to the request from the user;

a processor responsive to the first signal for selectively defining a second signal, including an inaudible ultrasonic transmission; and an ultrasonic transducer responsive to the processor for propagating the inaudible ultrasonic transmission to provide only in the control zone the audible representation, wherein the ultrasonic transducer outputs the inaudible ultrasonic transmission such that inherent properties of air within the control zone distort the inaudible ultrasonic transmission to provide the audible representation, wherein the ultrasonic transducer is aimed at a region likely to occupied by a head of the user, wherein the ultrasonic transducer is positioned so as to provide the audible representation only to the single control zone with which the output transducer is associated, wherein the audible representation is substantially inaudible outside of the control zone, including substantially inaudible to other users in adjacent control zones.

2. The system of claim 1 wherein the ultrasonic transducer is mounted to the console.

3. The system of claim 1 wherein the ultrasonic transducer is mounted above the console.

4. The system of claim 1, further comprising:

a loading zone;

a barcode scanner; and a packing zone;

wherein the loading zone, the barcode scanner, the console, and the packing zone are arranged in a row with the console located between the loading zone and packing zone, and wherein the control zone is substantially limited to the loading zone, the barcode scanner, the console, the packing zone, and an area adjacent the loading zone, the barcode scanner, the console, the packing zone occupied by the user.

5. A method for providing feedback to a user of a self-checkout system when the user is located within a spatially defined control zone, the method including the steps of:

recording a request from a user for assistance in interacting with a console when the user is located within the spatially defined control zone;

receiving a first signal from a central communications unit indicative of an audible representation from a supervisor console in response to the request from the user by a processor coupled to the console;

selectively defining a second signal, including an inaudible ultrasonic transmission by the processor; and propagating the inaudible ultrasonic transmission to provide only in the control zone the audible representation by an ultrasonic transducer controlled by the processor, wherein the ultrasonic transducer outputs the inaudible ultrasonic transmission such that inherent properties of air within the control zone distort the inaudible ultrasonic transmission to provide the audible representation, wherein the ultrasonic transducer is aimed at a region likely to occupied by a head of the user, wherein the ultrasonic transducer is positioned so as to provide the audible representation only to the single control zone with which the output transducer is associated, wherein the audible representation is substantially inaudible outside of the control zone, including substantially inaudible to other users in adjacent control zones.

* * * * *